United States Patent [19]

Petermann

[11] Patent Number: 4,830,105

[45] Date of Patent: May 16, 1989

[54] CENTRALIZER FOR WELLBORE APPARATUS

[75] Inventor: Steven G. Petermann, Plano, Tex.

[73] Assignee: Atlantic Richfield Company, Los Angeles, Calif.

[21] Appl. No.: 153,104

[22] Filed: Feb. 8, 1988

[51] Int. Cl.[4] ..... E21B 17/10

[52] U.S. Cl. ..... 166/241; 33/178 F

[58] Field of Search ..... 166/241, 174, 170, 176; 175/325; 33/178 F

[56] References Cited

U.S. PATENT DOCUMENTS

| | | | |
|---|---|---|---|
| 1,898,074 | 2/1933 | Bailey | 166/241 |
| 3,092,182 | 6/1963 | Blagg | 166/241 |
| 3,097,433 | 7/1963 | Cubberly, Jr. | 33/178 F |
| 3,555,689 | 1/1971 | Cubberly, Jr. | 166/241 X |
| 3,978,924 | 9/1976 | Roesner | 166/241 |
| 3,997,003 | 12/1976 | Adkins | 33/178 F |
| 4,425,966 | 1/1984 | Garney | 166/241 |
| 4,557,327 | 12/1985 | Kinley et al. | 166/241 |
| 4,615,386 | 10/1986 | Briscoe | 166/241 |
| 4,619,322 | 10/1986 | Armell et al. | 166/241 |

*Primary Examiner*—Stephen J. Novosad

*Attorney, Agent, or Firm*—Michael E. Martin

[57] ABSTRACT

A borehole centralizer includes an elongated shank member on which opposed head members are slidable and are connected to articulated arms which are movable radially inwardly and outwardly to centralize a tubing string or apparatus in a borehole in which the centralizer is disposed. A tension coil spring is disposed around the shank and connected to the opposed head members for exerting an axially directed force which is converted to radially directed forces urging the articulated arms radially outwardly. The centralizer is operable to exert substantially constant outward biasing forces on the articulated arms for a relatively wide range of borehole diameters.

3 Claims, 2 Drawing Sheets

CENTRALIZER FOR WELLBORE APPARATUS

BACKGROUND OF THE INVENTION

1. Field of the Invention

The present invention pertains to a centralizer mechanism for centering wellbore tools and other members insertable in a wellbore or a cylindrical tubular member.

2. Background

Various types of centralizer devices are known for centering wellbore tubular members and downhole tools during operations in a borehole. Certain types of wellbore tools such as borehole televiewing equipment require rather precise centering of the tool within the wellbore and ease of movement of the tool longitudinally within the wellbore in a uniform manner so that accurate readings may be taken along the wellbore axis. In this regard, there has been a need for an improved centralizing mechanism which will substantially center a tool or tubular member with respect to the wellbore axis, will move along the wellbore axis with relative ease and minimum frictional drag and may be easily adapted to fit within cylindrical wellbores or wellbore members of different diameters within a particular range without adversely affecting the operating characteristics of the centralizer. The present invention provides a centralizer mechanism which meets these desiderata as will be appreciated from the description which follows herein.

SUMMARY OF THE INVENTION

The present invention provides an improved centralizer mechanism for use with tools and other members insertable in wellbores, wellbore tubular structures and similar structures. The centralizer mechanism of the present invention includes a plurality of articulated arms which are biased to be urged radially outwardly into engagement with a wellbore wall, which wall may be formed by a casing or other tubular member in the wellbore and wherein the centralizer and a tool or other member connected thereto is substantially centered in the wellbore by radial forces acting on the articulated arm through spring means which exert an axial force generally along the axis of the wellbore. The arrangement of articulated arms and spring means is such that relatively uniform radially directed forces are exerted against the wall of the wellbore structure by the centralizer over a relatively wide range of wellbore diameters. The spring means is desirably characterized as a coil extension spring which is interposed between opposite head members of the centralizer and around a central stem member of the centralizer.

In accordance with another aspect of the present invention, an improved wellbore centralizer is provided which moves easily through restrictions in the wellbore and discontinuities in the wellbore wall thanks to the arrangement of the articulated arms and axially spaced apart wall engaging rollers connected to the arms.

Still further aspects of the invention include releasable connecting pin means which are adapted to release the pivot connections between the articulated arms and one end or head member so that the arms may be collapsed to pass through an obstruction or other reduced diameter point in the wellbore without jamming the centralizer.

The above-mentioned advantages and superior features of the centralizer of the present invention together with other important aspects thereof will be further appreciated by those skilled in the art upon reading the detailed description which follows.

DESCRIPTION OF A PREFERRED EMBODIMENT

Figure 1:
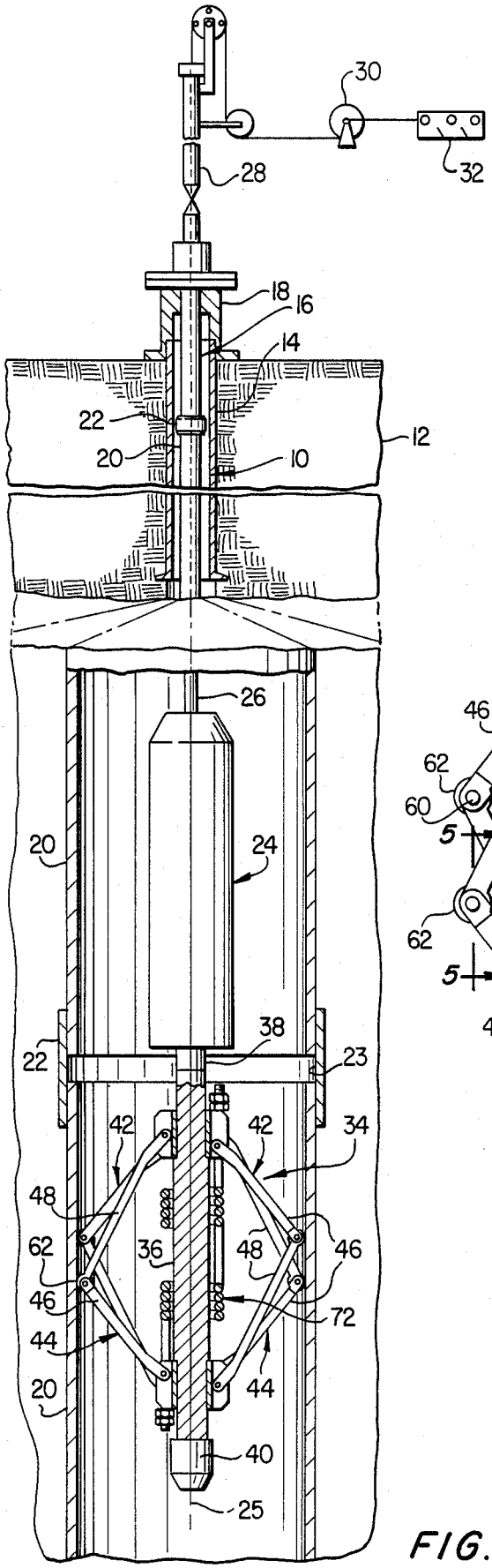
FIG. 1 is a section view in somewhat schematic form of a wellbore in which a tool has been inserted and is connected to the improved centralizer of the present invention.

In the description which follows like parts are marked throughout the specification and drawing with the same reference numerals, respectively. The drawing figures are not necessarily to scale and certain features of the invention and associated structure may be shown in somewhat schematic form in the interest of clarity and conciseness.

Referring to FIG. 1, there is illustrated a wellbore 10 which has been drilled into an earth formation 12 and which includes a casing portion 14 extending a certain depth into the wellbore and a further casing or drillstem tubular string 16 also extending within the wellbore from a wellhead 18. The casing string or drillstem 16 is made up of end to end connected cylindrical tubular sections 20 which may be coupled together by coupling portions 22. A portion of FIG. 1 is shown in somewhat enlarged scale in the interest of clarity.

Certain wellbore operations require the disposition of a tool such as the tool 24 to be extended in the wellbore whether it be "open hole" or within a casing such as the casing string 16 in a substantially centered position coincident with the longitudinal central axis 25 of the wellbore or the structure in which the tool is disposed. Apparatus known as a borehole televiewer, for example, requires relatively precise centering in the wellbore structure so that the desired accuracy of the signal generated by the televiewer device is obtained. A tool such as the tool 24 may be lowered into the wellbore on a wireline cable 26 by way of a conventional wireline lubricator 28 and associated reeling mechanism 30 and control apparatus 3 for operating the wireline reeling apparatus and the tool 24.

The tool 24 is substantially centered in the casing string 16 by an improved centralizer, generally designated by the numeral 34. The centralizer 34 includes an elongated central stem or shank member 36 which is provided with opposed threaded and portions and is adapted to be connected at its upper end to a sub 38 forming part of the tool 24. The stem member 36 may also be connected to a lower end cap member 40 or to other structure extending in the wellbore below the centralizer 34. The stem member 36 may be a generally cylindrical member and may have a hollow interior portion, not shown, forming passage means for conducting fluid, forming a cableway, or forming a passage for other structure. The centralizer 34 includes a plurality of articulated arms 42 and 44 which are formed of arm segments 46 and 48 of unequal length, respectively.

Figure 2:
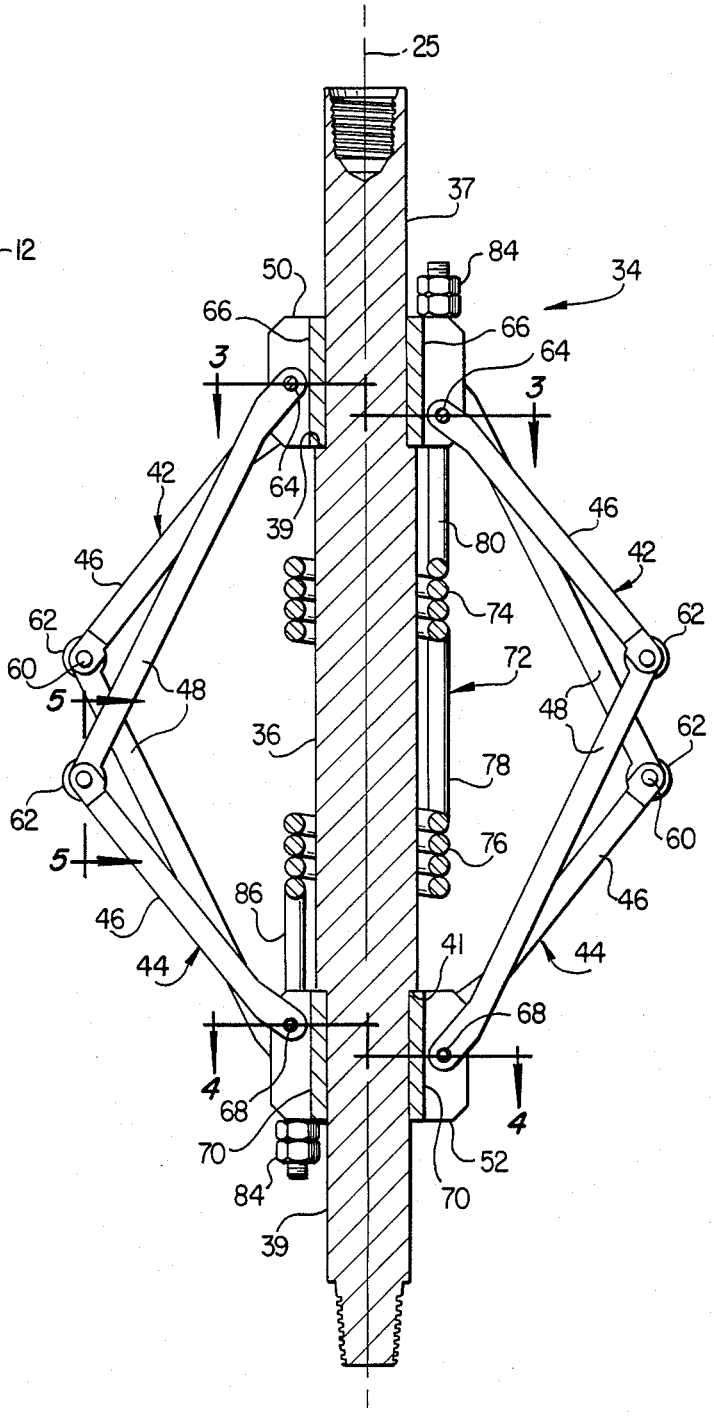
FIG. 2 is a central longitudinal section view of the centralizer illustrated in FIG. 1 on a larger scale.
Figure 3:
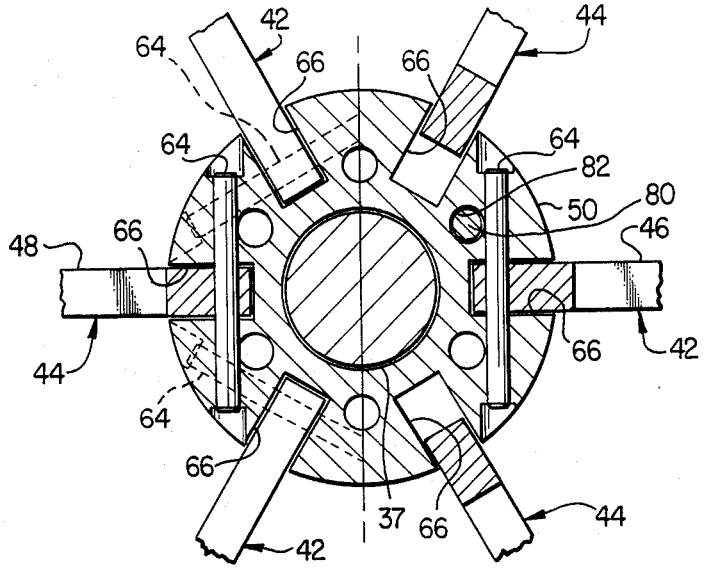
FIG. 3 is a section view taken substantially along the line 3—3 of FIG. 2.
Figure 4:
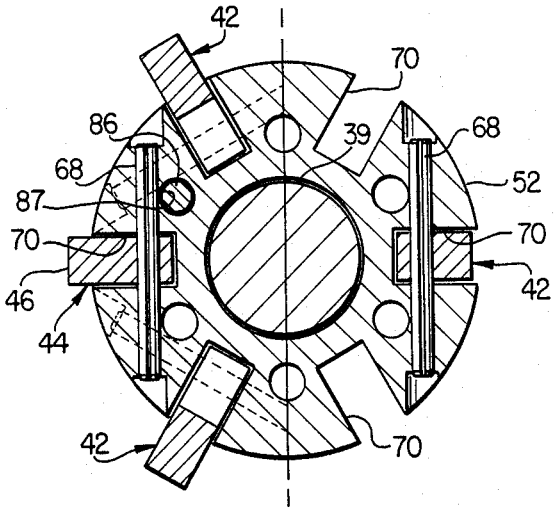
FIG. 4 is a section view taken substantially along the line 4—4 of FIG. 2.

The arms are spaced apart circumferentially about the central longitudinal axis 25 and are preferably equally spaced as indicated by FIGS. 3 and 4. The arms 42 and 44 are connected to opposed slidable head members 50 and 52 which are slidably mounted on reduced diameter portions 37 and 39, respectively of the stem member 36, FIG. 2. The arrangement of the arms 42 and 44 is such that they appear as somewhat mirror images of each other in the embodiment of the centralizer 34 illustrated. There are, thus, three arms 42 and three arms 44 spaced apart substantially equally about the axis 25.

Figure 5:
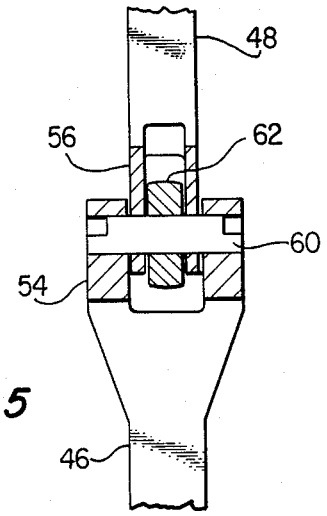
FIG. 5 is a section view taken along the line 5—5 of FIG. 2.

Referring to FIGS. 2 and 5, each of the arms 42 and 44 are connected to each other at a pivot connection formed by cooperating clevis portions 54 and 56 of the respective arm segments 46 and 48 which are nested one within the other and interconnected by a pivot pin 60 which also supports within the clevis 56 a roller 62. The arms 42 and 44 are each, as shown by example in FIG. 3, pivotally connected to the head member 50 by pivot pins 64 and the arms are disposed in elongated grooves 66 formed in the head member 50 for receiving the ends of the segments 46 and 48 opposite the clevis ends of these segments, respectively. In like manner, as shown in FIG. 4, the arms 42 and 44 are also pivotally connected to the head member 52 by pivot pins 68 and the ends of the arms 42 and 44 connected to the head member 52 are disposed in longitudinal grooves 70 formed in the head member and similar to the groove 66. The head members 50 and 52 may, in fact, be identical in construction.

Referring to FIGS. 2 and 3, the head members 50 and 52 are interconnected by coil spring means 72 comprising coil portions 74 and 76 which are interconnected by an axially extending uncoiled intermediate portion 78 forming an integral part of the spring member. The coil 74 terminates in an axially extending shank portion 80 which extends within a bore 82 formed in the head member 50, is threaded on its distal end and is secured to th head member by a lock nut assembly 84. In like manner, as shown in FIGS. 2 and 4, the coil 76 terminates in an axially extending shank portion 86 which extends through a bore 87 in the head member 52 and is secured thereto by a lock nut assembly 84 also.

The spring 72 is configured such that whentthe arms 42 and 44 are biased into their radially outermost extended positions of the rollers 62, that is when the head members 50 and 52 are urged into engagement with transverse surfaces 39 and 41, respectively, a predetermined biasing force is exerted between the roller 62 and the borehole wall in which the centralizer 34 is disposed. If the centralizer 34 is operated in casings or borehole structures having a smaller diameter, the arms 42 and 44 are, of course, urged to move radially inwardly toward the shank member 36. However, the force urging the arms 42 and 44 to move radially outwardly may change very little since the net radially outwardly directed forces acting on the rollers 62 remain unchanged even though the tension in the spring 72 will increase. Stated another way, the centralizer 34 is configured such that the axially directed forces exerted by the spring 72 increase as the effective moment arm tending to urge the arms 42 and 44 outwardly decreases so that a relatively unchanged outward biasing force is exerted by the roller 62 against the borehole wall. The arrangement of the single or tandem tension spring interposed between the head members 50 and 52 is advantageous in that the spring is conveniently disposed between the arms 42 and 44 and the centralizer 34 is relatively compact. However, those skilled in the art will recognize that opposed axial compression springs might be mounted along the shank 36 both above the head member 50 and below the head member 52 in the position shown of the centralizer in FIG. 2 to provide the axial biasing forces exerted on the arms 42 and 44.

Another advantage of the centralizer 34 resides in the arrangement of the articulated arms 42 and 44 having the arm segments of unequal length so that by, in essence, reversing the way in which the arms are connected to the head members one set of rollers 62 is disposed in a first plane normal to the longitudinal axis of the shank 36 and another set of rollers 62 is disposed in a second plane spaced from and parallel to the first plane so that if the centralizer passes over a discontinuity in the borehole wall surface such as the groove 23, FIG. 1, formed between the casing members 20, the arms will not become lodged in the groove, if the spacing between the sets of rollers is sufficient.

Yet another advantage of the centralizer 36 is in regard to the way in which the pivot connections are formed by the pins 64 and 68. Typically a centralizer may be required to pass through restricted portions of a borehole in which the diameter of the passageway through which the centralizer must pass is less than other portions of the borehole. If, for some reason, the centralizer arms 42 and 44 do not retract freely radially inwardly aganst the bias of the spring 72 the lowermost connections of the arms 42 and 44 to the head member 52, formed by the pin 68, will fail in shearing the pins 68 at a force lower than the force required to shear the connection formed by the pivot pins 64 with the head member 50. Accordingly, the arms 42 and 44 will retract radially inwardly upon shearing of the pivot pins 68 so that the centralizer may be retrieved uphole with the arms in their radially collapsed or retracted positions. Thanks to the space between the spring coils 74 and 76 the arms may retract radially inwardly to minimize the diameter of the centralizer 34 by allowing the rollers 62 to nest in position directly adjacent or in contact with the shank 36 so that the overall diameter of the centralizer 34 in its radially innermost retracted or collapsed position is further reduced.

The operation of the centralizer 34 is believed to be understandable to those of ordinary skill in the art of centralizers from the foregoing description. The centralizer 34 may be constructed of conventional engineering materials for downhole equipment and following conventional fabricating practices. Those skilled in the art will also recognize that various substitutions and modifications may be made to the embodiment described without departing from the scope and spirit of the invention as recited in the appended claims.

What is claimed is:

1. A centralizer for use with apparatus insertable in a borehole for centralizing said apparatus in said borehole, said centralizer comprising:

generally centrally disposed shank means including means for connecting said centralizer to said apparatus;

a plurality of radially extendable articulated arms, each of said arms including arm segments pivotally connected to each other, each of said arms being connected at its opposite end, respectively, to means on said shank means in such a way that said arms are radially extendable and retractable with respect to a generally central longitudinal axis of said centralizer, at least one of said means on said shank means being axially slidable on said shank means;

spring means operably associated with said means on said shank means for exerting axially directed forces on said means on said shank means to urge said arms to extend radially outwardly into engagement with the wall of said borehole to centralize said apparatus in said borehole; and the segments of each of the said arms are of unequal length and selected ones of said arms are mounted such that the shorter segments of said selected arms are connected to said shank means at an end of said shank means opposite the end to which others of said shorter segments of said arms are connected to said shank means whereby the point of contact of certain ones of said arms with said wall is axially spaced from the point of contact of others of said arms with said wall, respectively.

2. A centralizer for use with apparatus insertable in a borehole for centralizing said apparatus in said borehole, said centralizer comprising:

generally centrally disposed shank means including means for connecting said centralizer to said apparatus;

a plurality of radially extendable articulated arms, each of said arms including arm segments pivotally connected to each other, each of said arms being connected at its opposite end, respectively, to means on said shank means in such a way that said arms are radially extendable and retractable with respect to a generally central longitudinal axis of said centralizer, at least one of said means on said shank means being axially slidable on said shank means;

spring means operably associated with said means on said shank means for exerting axially directed forces on said means on said shank means to urge said arms to extend radially outwardly into engagement with the wall of said borehole to centralize said apparatus in said borehole; and said arms are connected to said means on said shank means at opposite ends by respective connection means wherein said connection means at one end are structurally weaker than said connection means at the opposite end in a way such that when said arms are forced to retract radially inwardly said connection means at the one end opposite the end in the direction of withdrawal of said centralizer from said borehole are frangible to permit full retraction of said arms by severing the connection of said arms to said shank means at said one end.

3. A centralizer for use with apparatus insertable in a borehole for centralizing said apparatus in said borehole, said centralizer comprising:

an elongated shank member including means for connecting said centralizer to said apparatus;

opposed head members slidably disposed on said shank member and spaced apart from each other on said shank member;

a plurality of radially extendable articulated arms disposed circumferentially spaced apart about said shank member with respect to a longitudinal axis of said centralizer, said arms each including at least two arm segments which are of unequal length and are pivotally connected to each other and to said head members, respectively, and in such a way that said arms are radially extendable and retractable with respect to said longitudinal axis;

a tension coil spring disposed around said shank member and connected at its opposite ends to said head members, respectively, for exerting axially directed forces on said head members to move toward each other and to cause said arms to pivot radially outwardly into engagement with the wall of said borehole to centralize said apparatus in said borehole; and selected ones of said arms are mounted on said shank member such that the shorter segments of said selected arms are connected to one of said head members at an end of said shank member opposite the end to which others of said shorter segments of said arms are connected to the other head member whereby the point of contact of certain ones of said arms with said wall is axially spaced from the point of contact of others of said arms with said wall, respectively.

* * * * *